US005253462A

United States Patent [19]

Blitzer et al.

[11] Patent Number: 5,253,462

[45] Date of Patent: Oct. 19, 1993

[54] FLUTED METAL LAY-IN SUBCEILING PANEL

[76] Inventors: Jacob H. Blitzer, 400 S. Saltair, Los Angeles, Calif. 90049; Richard M. O'Toole, 4495 Huntley Ave., Culver City, Calif. 90302

[21] Appl. No.: 824,944

[22] Filed: Jan. 24, 1992

[51] Int. Cl.[5] ..... E04B 9/00

[52] U.S. Cl. ..... 52/484; 52/311.2; 52/488; 52/489; 52/762; 52/314

[58] Field of Search ..... 52/484, 488, 475, 483, 52/485, 814, DIG. 8, 450, 453, 335, 671, 674, 762, 772, 311, 489, 486, 314

[56] References Cited

U.S. PATENT DOCUMENTS

| | | | |
|---|---|---|---|
| 3,038,573 | 6/1962 | Nuernberger | 52/483 |
| 3,153,304 | 10/1964 | Evangelista | 52/484 X |
| 3,176,432 | 4/1965 | Doolittle, Jr. | 52/489 X |
| 3,277,624 | 10/1966 | Cornell | 52/484 |
| 3,280,518 | 10/1966 | White, Jr. | 52/475 |
| 4,413,457 | 11/1983 | Lahm et al. | 52/484 X |
| 4,569,175 | 2/1986 | Abciuk | 52/484 |
| 4,640,064 | 2/1987 | Goodworth, II | 52/475 X |
| 4,747,246 | 5/1988 | Sanborn | 52/DIG. 8 X |
| 4,848,054 | 7/1989 | Blitzer et al. | 52/484 X |

FOREIGN PATENT DOCUMENTS 0080633 4/1963 France .

*Primary Examiner*—Carl D. Friedman
*Assistant Examiner*—Robert J. Canfield
*Attorney, Agent, or Firm*—J. E. McTaggart

[57] ABSTRACT

For use in a suspended ceiling of the well known type utilizing inverted T-bar support framework, novel panels of this invention provide a pattern of parallel flutes extending the full length of the panel. Panels fit between adjacent cross runners of a T-bar type suspension system, supported removably along two opposite sides in a manner which integrates the fluted panels and the downwardly exposed T-bar flanges into a uniform pattern substantially disguising the presence of the T-bars. Associated trim members of a miniature beam style may be attached to T-bar main runners as a finish accent between ends of end-adjacent panels and, if desired, around the perimeter of the subceiling where they serve to conceal wall angles which provide support to panels at the perimeter. Panels may be readily produced from flat sheet metal stock in a forming process and are easily installable and removable in the suspended subceiling framework.

12 Claims, 4 Drawing Sheets

FLUTED METAL LAY-IN SUBCEILING PANEL

FIELD OF THE INVENTION

The present invention, in the field of suspended subceilings, relates to subceiling panels having a fluted configuration cooperating functionally and aesthetically with standard subceiling suspension framework.

BACKGROUND OF THE INVENTION

Ongoing architectural evolution creates new unsatisfied needs for special panel configurations for suspended ceilings to satisfy particular environmental and aesthetic requirements and at the same time provide improvements in essential parameters such as ease of installation, safety, and cost effectiveness.

Suspended ceilings commonly utilize a framework of inverted T-bar rails to support panels which are typically of standard size such as 2'×2' or 2'×4'. As a departure from conventional basic flat solid panels or acoustical boards fabricated from fibrous or composition materials, panels providing special geometric decorative treatments have utilized various patterns such as louvered or gridded arrays, and have typically employed material such as wood, plastic, or fibrous mixtures.

The present invention addresses a new alternative to such known panels to create a visual ceiling plane configured as a fluted pattern formed economically from sheet metal interacting functionally and architecturally in combination with inverted T-bar framework to provide a particular desired finished form, appearance and panel accessability, along with the advantages of metal in durability and safety relative to fire hazard.

OBJECTS OF THE INVENTION

It is a primary object of the present invention to provide a novel panel construction, in a suspended ceiling utilizing inverted T-bar support framework, having a uniform pattern of parallel flutes, each having a cross-section tapering toward the bottom, extending the full length of the panel.

It is a further object to configure the panel to fit between adjacent cross runners of a standard T-bar type suspension system in a manner to support the panels removably along two opposite sides in a manner which integrates the downward exposed surface of the T-bar into a continuous regular lateral pattern encompassing a plurality of panels and T-bars, in effect tending to disguise the presence of the T-bars.

It is a further object to provide associated trim members of a miniature beam style between ends of end-to-end panels and in some instances around the perimeter of the subceiling, and to provide edge support means in the subject panel compatible with such trim members.

It is a still further object that panels of the novel construction be readily producible and easily installable in a suspended subceiling framework of the inverted T-bar type.

An understanding of how the present invention may be made and used to accomplish these and other objects and advantages will be gained from a study of the following description with reference to the accompanying drawings.

DETAILED DESCRIPTION

Figure 1:
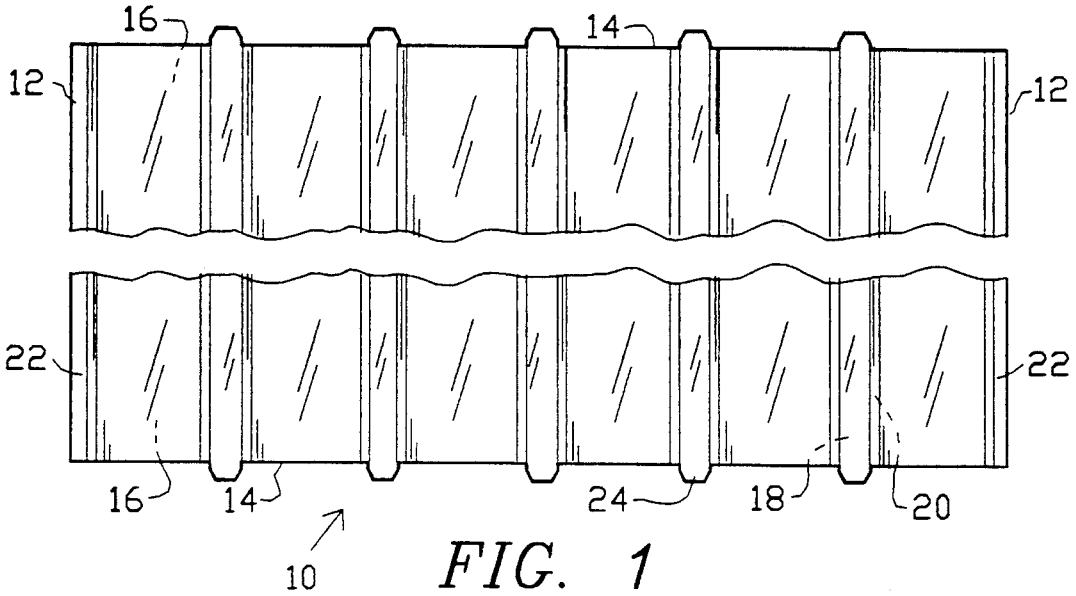
FIG. 1 is a panel of this invention shown in a top view in which a central portion is cut away.

FIG. 1 is a top view of a panel 10 of the present invention. Typically it is made rectangular in shape with side edges 12 typically longer than the end edges 14; in the drawing a mid portion is cut away for simplification. Panel 10 is formed from a single sheet of metal, such as steel or aluminum, to have a series of parallel flutes with their bottom portions 16 located at a lower plane, alternating with a series of parallel top strips 18 located at an upper plane. In this illustrative embodiment, bottom portions 16 are made flat and are separated from top strips 18 by inclined flat side walls 20; however the cross-section of the bottom portions 16 and sidewalls 20 could be shaped alternatively, and could include curved as well as flat surfaces using well-known techniques of sheet metal forming.

Along each side edge 12, a support strip 22 is formed so as to be located in the upper plane. Along each end edge 14, as extensions of top strips 18 in the upper plane, support tabs 24 extend beyond the ends of the bottom portions 16 and sidewalls 20 which are cut off squarely at the basic plane of the end edges 14. Panel 10 is sized to enable the fluted portion below the upper plane to readily fit downwardly into a standard (2'×4') cell opening of conventional inverted T-bar support framework (15/16" flange), such that the support strips 22 and the support tabs 24 extend beyond the cell opening and thus serve to support the panel on upper surfaces of the flanges of the inverted T-bar framework.

Figure 2:
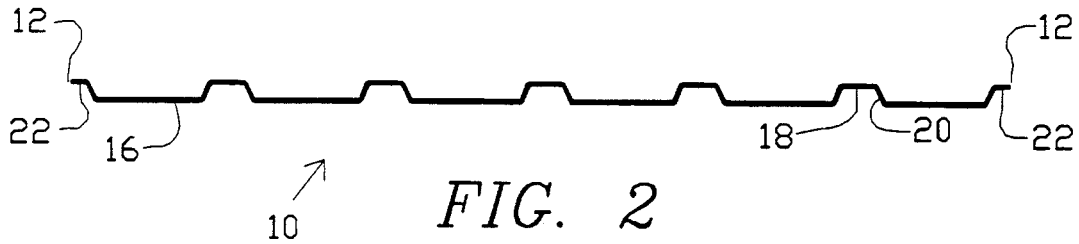
FIG. 2 is a cross-section of the panel of FIG. 1.

FIG. 2 is a cross-sectional view of the panel 10 of FIG. 1 taken at any axis parallel to the end edges, showing the panel 10 with the side edge support strips 22 and top strips 18 located at the upper plane, and the flutes with relatively wide bottom portions 16 located at the lower plane formed integrally with flanking sidewalls 20 and top strips 18.

Figure 3:
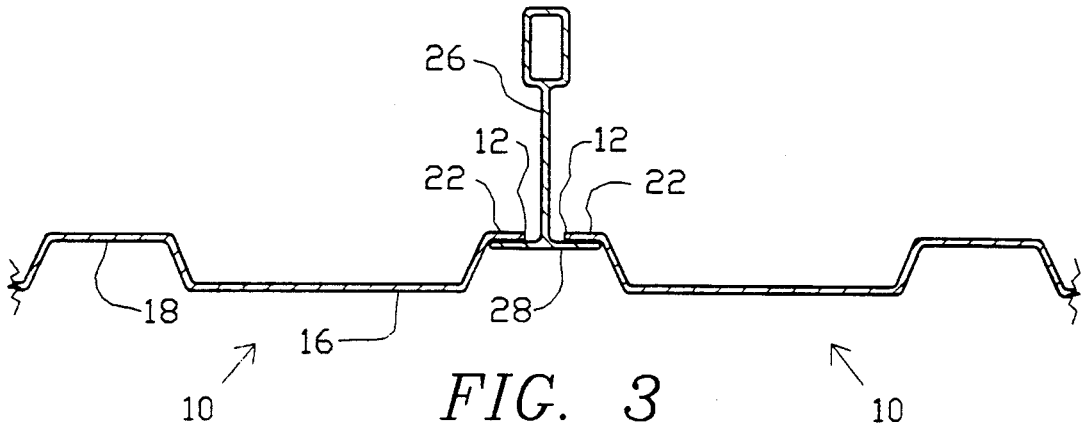
FIG. 3 is an enlargement of a portion of FIG. 2 resting on a T-bar cross runner.

FIG. 3 is an enlarged view of portions of a pair of adjacent panels 10, each as in FIGS. 1 and 2, showing the panels 10 each supported on an opposite side of a typical inverted T-bar cross runner 26 which is assumed to be suspended in a conventional manner from overhead building structure. In each panel 10, the side edge support strip 22 is seen extending onto the upper side of the flange of the T-bar cross runner 26 so as to support the panels 10.

It is apparent that as viewed from beneath, the exposed lower side 28 of the T-bar cross runner 26 appears similar to the lower sides of the top strips 18, so as to give the ceiling a uniform appearance in which the exposed lower side 28 of the T-bar runner 26 is disguised and the support strips 22 along the side edges 12 of the panels are concealed above the flange of T-bar cross runner 26.

Figure 4:
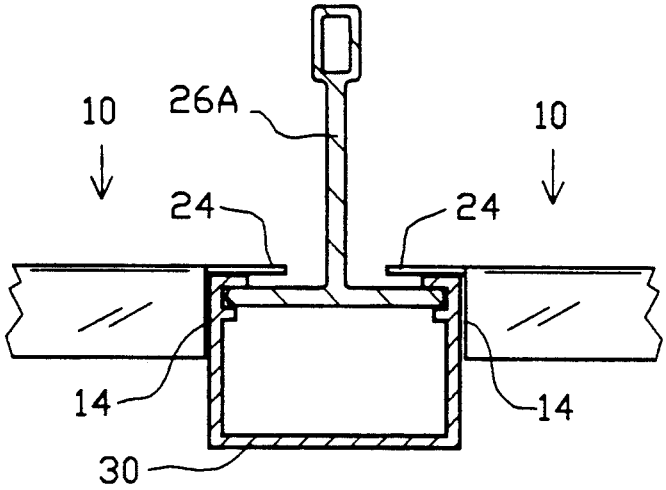
FIG. 4 is a cross-section through a T beam main runner fitted with a miniature beam, located between the ends of two panels.

FIG. 4 is a cross-section taken at a T-bar main runner 26A fitted with a miniature beam 30 located between adjacent ends of two panels 10, seen abutting the vertical sidewalls of beam 30. Panels 10 are seen to be supported by support tabs 24 extending onto the upper surfaces of beam 30 which in turn are supported on the upper side of the flange of the T-bar main runner 26A, so as to support the panels 10 along their end edges 14, where squarely cut-off ends of the flutes closely abutt the vertical sidewalls of beam 30 to provide a finished appearance.

Figure 5:
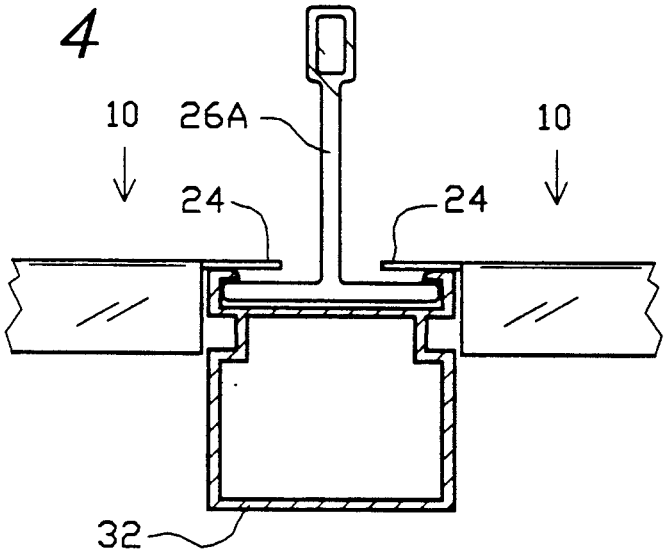
FIG. 5 shows the subject matter of FIG. 4 fitted with a deeper alternative beam embodiment.

FIG. 5 is a main runner cross-section as in FIG. 4 showing an alternative style of miniature beam 32 which like beam 30 of FIG. 4 has a width approximating the width of the T-bar flange, but extends further downward, well below the lower plane of the panels 10. Beam 32 may be realized as an embodiment of U.S. Pat. No. 4,848,054, MINIATURE CEILING BEAM T-BAR COVER CAP, issued to Blitzer and O'Toole.

Figure 6:
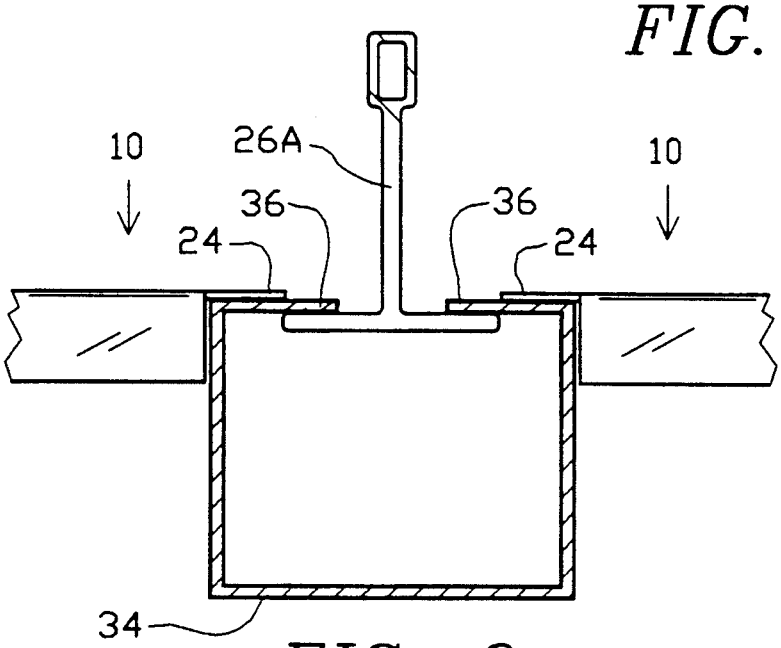
FIG. 6 shows the subject matter of FIG. 4 fitted with a larger alternative beam embodiment.

FIG. 6 is a cross-section as in FIGS. 4 and 5 showing another alternative style of miniature beam 34 which is larger in both cross-sectional dimensions than the beams of FIGS. 4 and 5. Being wider than the T-bar flange, the beam 34 includes top side return strips 36 for supporting beam 34 on the T-bar flange; return strips 36 in turn support panels 10 via tabs 24.

It should be apparent that in the above-described structure, as an alternative to forming side edge support strips 22 and/or end support tabs 24 integrally from a common sheet of metal, these could be provided in the form of a continuous strip or an array of small separate rectangular strips attached onto the top of the panel at appropriate locations by welding, riveting or other means. Such use of separate support means at the end edge may be required where the panel must be cut shorter than original, and could facilitate the manufacturing of a full length panel since the end edge would be entirely straight without any projecting tabs.

As a matter of precise detail with regard to overall uniformity of appearance, it will be noted that the alignment of the lower surface of the top strips 18 relative to the lower exposed surface of the T-bar flange may be subject to a small deviation due to the thickness of the T-bar flange; and where miniature beams are placed onto the flanges of main runners as in FIGS. 4–6, any thickness added above the flange introduces a further upward deviation. These variations are generally considered to be within an acceptable range, however as on option a more precise relationship may be obtained by forming support strips 22 to be at a slightly higher level than top strips 18 and/or similarly forming tabs 24 to be slightly higher level than the top strips 18 in an additional forming operation to introduce a Z shaped offset.

Figure 7:
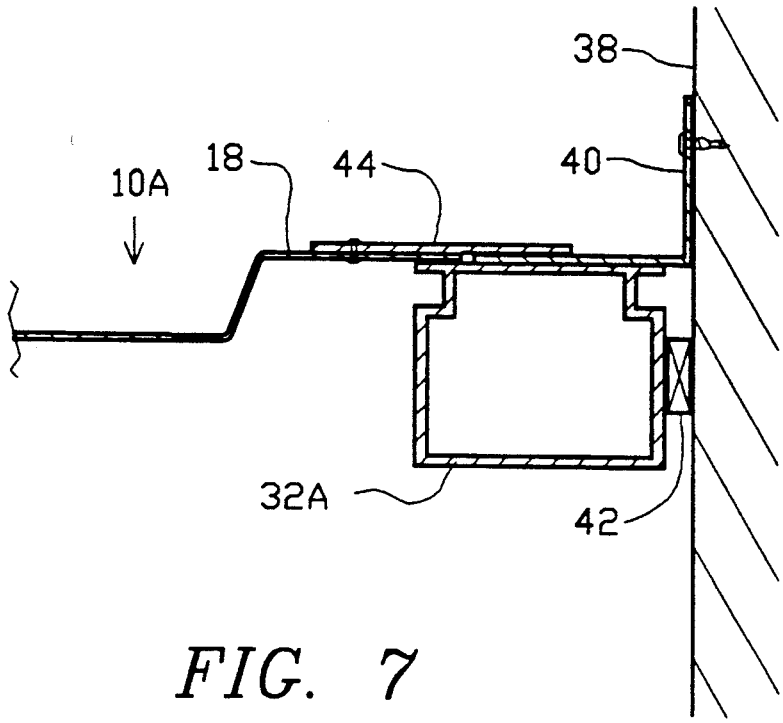
FIG. 7 shows a cross-sectional view of a portion of a subceiling of this invention at a wall perimeter region in a first instance of flute interaction with a perimeter beam.

FIG. 7 shows a cross-sectional view of a portion of a subceiling of this invention at a wall perimeter region where an edge of a panel 10A is supported by a modified miniature beam 32A, which may be a version of beam 32 in FIG. 5, mounted to a wall 38 via a continuous wall angle 40 suitably attached to the wall 38 and to the beam 32A, preferably spacing the beam 32A from the wall 38 by a spacer 42 such as a continuous strip of foam material with double-sided adhesive.

Panels around the perimeter of a subceiling often must be cut to a smaller size; this example shows an instance where it happens that panel 10A must be cut to fit along the wall perimeter such that the inward facing sidewall of beam 32A coincides with the panel's top strip 18. In this instance, a metal support strip 44 is attached onto the top strip 18 of panel 10A so as to extend onto the top of wall angle 40 and thus provide support to panel 10A along that side edge. Support strip 44 may be made to run continuously along the panel edge, or it may be made in the form of a series of individual small strips.

Figure 8:
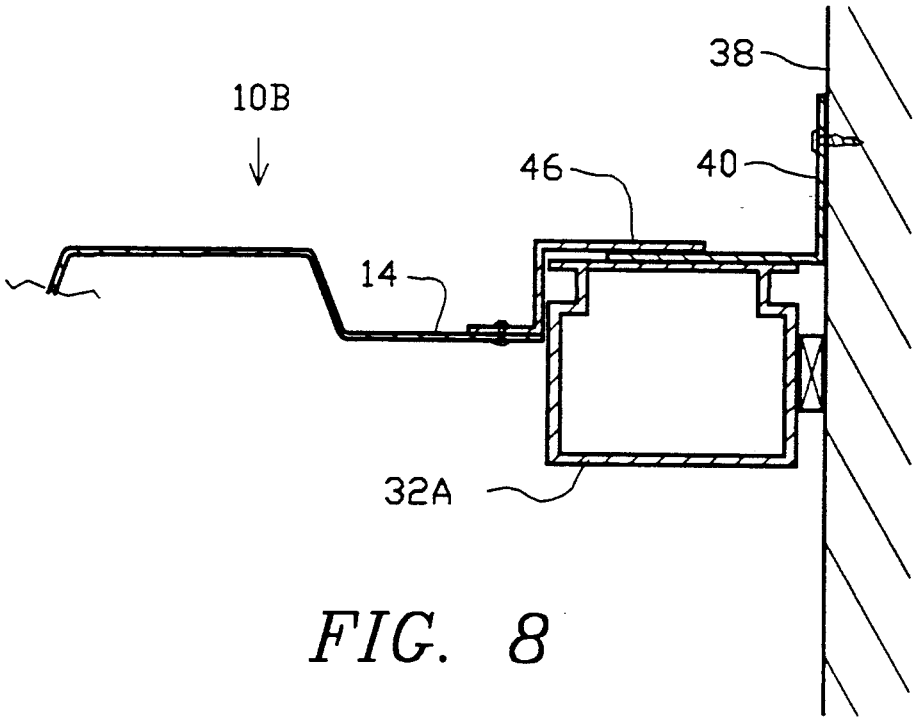
FIG. 8 shows a cross-sectional view of a portion of a subceiling of this invention at a wall perimeter region in a second instance of flute interaction with a perimeter beam.

FIG. 8 shows a cross-sectional view where the wall 38 and perimeter beam 32A are as in FIG. 7; however in this instance the inward facing sidewall of beam 32A coincides with the panel's lower portion, thus a Z-shaped support bracket 46 is required to support he panel 10B on angle bracket at the required level. Support bracket 46 may be made to run continuously along the panel edge or else made as a series of individual small clips.

Similar beam support and appearance treatment may be readily provided along those portions of the wall perimeter bordering the end edges of the panels. If the panels are used in their original full length, the support tabs (24, FIG. 1) may be utilized; where the panels must be cut to a shorter length, end edge support strips may be attached onto top strips 18 in a similar manner to that shown in FIG. 7 for side edge support strip 44.

Figure 9:
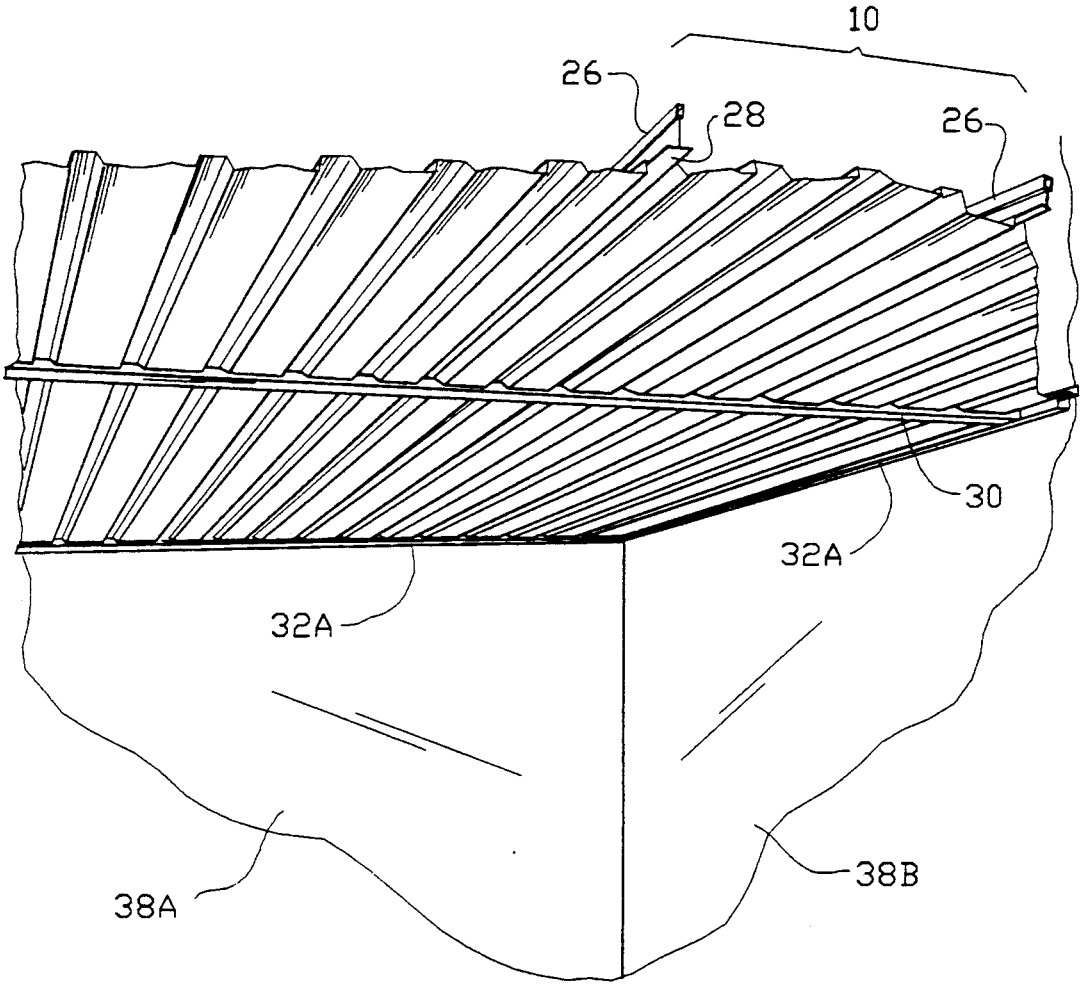
FIG. 9 is a perspective view of a corner portion of a room showing a portion of a subceiling made in accordance with this invention, as viewed from beneath.

FIG. 9 is a perspective view of a portion of a room, at a corner formed between walls 38A and 38B, showing a portion of a subceiling of this invention, as viewed from below. The subceiling is shown cutaway along the near side, showing the ends of a pair of inverted T-bar cross runners 26 supporting an array of panels of which panel 10 is typical. The exposed bottom sides 28 of cross runners 26 are seen to blend in with the overall fluted ceiling pattern. A miniature beam 30 is shown at a main runner location along the boundary between abutting end edges of end-adjacent panels. Perimeter beams 32A are shown forming a border along the wall surfaces.

Typically panels 10 are made to fit a standard 2'×4' cell pattern, for which the panel length is made approximately 46.9" to allow for beams along the ends; however various styling treatments may be readily realized by custom-fabricating the panels to any desired length.

As an alternative to plain sheet metal, the panels 10 may be formed from perforated sheet metal; in addition to providing a distinctive decorative effect, a degree of ventilating function may be served by making the perforations sufficiently large.

Where panels of a subceiling are made to have a special surface treatment, such as texture, color or perforations, the T-bar flange may be covered by a decorative sheet metal or plastic cover cap made to match the surface treatment of the panel to thus preserve a uniform overall appearance.

The invention may be embodied and practiced in other specific forms without departing from the spirit and essential characteristics thereof. The present embodiments are therefore to be considered in all respects as illustrative and not restrictive, the scope of the invention being indicated by the appended claims rather than by the foregoing description; and all variations, substitutions and changes which come within the meaning and range of equivalency of the claims are therefore intended to be embraced therein.

What is claimed is:

1. A panel system for a subceiling of the type having panels supported on a grid system of inverted T-bar framework of main runners and cross runners suspended from building structure above, said panel system comprising:

a plurality of like rectangular panels formed from sheet metal, each panel having a pair of end edges at opposite ends thereof and a pair of side edges at opposite sides thereof, each said panel being formed to define an array of like adjacent parallel flutes each having a bottom portion flanked by a pair of opposed sidewall portions formed integrally therewith from the sheet metal, adjacent pairs of flutes being joined at upper edges thereof via a generally horizontal top spacer strip formed integrally therewith from the sheet metal;

side support means comprising a pair of flat horizontal side support strips extending one along each of the two side edges thereof so as to form a continuation from the upper edge of each of a pair of opposed outermost sidewall portions, said side support strips having a width less than half that of the top spacer strips, said side support strips being adapted to support said panel along side edges thereof upon upper surfaces of T-bar flanges extending horizontally at a low extremity of adjacent pairs of inverted T-bar subceiling support cross runners in a manner to dispose the top spacer strips at an elevation approximating that of the T-bar flanges, and to dispose the upper edges of each of a pair of opposed outermost sidewall portions immediately adjacent to a corresponding T-bar flange edge, thus causing a lower surface of the flange to be exposed downwardly, the top spacer strips being formed to simulate, as viewed from beneath, the exposed lower surface of the flange; and end support means comprising a plurality of flat horizontal extensions in an upper plane of said panels at opposite ends thereof, extending over outer edges of corresponding ones of the main runner flanges so as to provide support of said panels thereupon;

whereby said plurality of panels, placed side by side in the subceiling grid system, is enabled to form a continuous pattern of adjacent parallel flute shapes, as viewed from beneath, such that the presence of the cross runners between the panels is caused to be substantially disguised by similarity between the lower surfaces of the top spacer strips and the exposed lower surfaces of T-bar flanges.

2. The panel system as defined in claim 1 wherein the side support strips are formed as integral parts of said panel.

3. The panel system as defined in claim 1 further comprising an elongated miniature beam member, having a pair of opposed vertical sidewalls, attached adjacently beneath and parallel to each of designated main runners of the T-bar support framework, so as to provide a decorative spacer beam between end edges of end-to-end adjacent pairs of said panels, the sidewall portions and bottom portion of each flute being cut off squarely at two end planes of each panel so as to enable ends of the flutes to abut vertical sidewalls of said beam members.

4. The panel system as defined in claim 3 wherein said beam member is made to have along upper edges of two sidewalls thereof, a pair of inwardly facing channel grooves adapted to fit over two opposed extending edges of bottom flanges of the inverted T-bar main runners members of the framework, the beam member being made compliant and resilient so as to enable the beam member to be attached over the flanges of the inverted T-bar main runners members by temporarily forcing the channel grooves apart.

5. The panel system as defined in claim 1 wherein said end support means comprise a plurality of extension tabs formed integrally one at each end of each of the top spacer strips, extending beyond each of two end planes defined by squarely cut off ends of the sidewall portions and the bottom portion of each flute of said panel.

6. The panel system as defined in claim 1 wherein said end support means comprise a pair of rectangular flat horizontal end support strips attached to said panels along each end edge thereof atop the top spacer strips, said end strips being made to extend beyond each of two end planes defined by squarely cut off ends of the sidewall portions and the bottom portion of each flute of said panels.

7. The panel system as defined in claim 1 wherein said end support means comprise a plurality of rectangular flat horizontal end support tabs attached to said panels atop selected ones of the top spacers, said end support tabs being made to extend beyond each of two end planes defined by squarely cut off ends of each flute of said panel.

8. The panel system as defined in claim 3 further comprising a plurality of miniature perimeter beams, each having an opposed pair of vertical sidewalls flanking a bottom surface, disposed around said subceiling in peripheral regions thereof, the beams being affixed to adjacent walls of building structure via wall angle members attached atop the beams, the beams being disposed with upper surfaces thereof at an elevation approximating that of the T-bar flanges and the top spacers of the panels, so as to provide a perimeter trim surrounding the subceiling.

9. The panel system as defined in claim 8 further comprising a plurality of support clips attached to said panels in regions thereof around a subceiling perimeter so as to extend over a portion of the wall angle members and thereby provide support for said panels on the wall angle members.

10. The panel system as defined in claim 9, wherein each of a plurality of said panels located adjacent to a perimeter of said subceiling, having been required to be cut to a width narrower than a standard width, has a bottom portion thereof abutting a corresponding portion of said perimeter beam, corresponding ones of said support clips being made in a Z shaped offset configuration and affixed atop selected bottom portions of flutes of each panel so as to provide support for said panels via the support clips upon the wall angle members such as to locate the top spacers of the panels approximately in the plane of the upper surfaces of the perimeter beams.

11. The panel system as defined in claim 9, wherein each of a plurality of said panels located adjacent to a perimeter of said subceiling, has adjacent to said perimeter beam an upper portion, such as a side support strip or a portion of a top spacer from which a portion of the panel has been cut off and removed to provide perimeter fitting, corresponding ones of said support clips being made in a flat rectangular shape and affixed atop corresponding upper portions of the panel so as to provide support for said panels upon the wall angle members such as to locate the top spacers of the panels approximately in the plane of the upper surfaces of the perimeter beams.

12. The panel system as defined in claim 1 wherein the bottom portion of each of the flutes is made to be flat and horizontal, and the sidewalls are made to be flat and to be inclined at an obtuse angle relative to the bottom portion.

* * * * *